United States Patent [19]

Blacker et al.

[11] Patent Number: 4,469,987

[45] Date of Patent: Sep. 4, 1984

[54] MEANS FOR ENHANCING BRIGHTNESS OF A MONOCHROME CRT WITHOUT LOSS OF RESOLUTION

[75] Inventors: Allen P. Blacker; Khem K. S. Garewal, both of Hoffman Estates, Ill.

[73] Assignee: Zenith Electronics Corporation, Glenview, Ill.

[21] Appl. No.: 314,301

[22] Filed: Oct. 23, 1981

[51] Int. Cl.[3] ..... H01J 29/46; H01J 29/56

[52] U.S. Cl. ..... 315/14; 313/415

[58] Field of Search ..... 315/14, 15, 16; 358/242, 252, 253; 313/415, 461

[56] References Cited

U.S. PATENT DOCUMENTS

| | | | |
|---|---|---|---|
| 3,286,113 | 11/1966 | Benway | 313/415 |
| 3,696,261 | 10/1972 | Miyaoka | 313/69 |
| 3,995,194 | 11/1976 | Blacker, Jr. et al. | 315/16 |
| 4,177,399 | 12/1979 | Muccigrosso et al. | 358/253 |

*Primary Examiner*—Theodore M. Blum

*Attorney, Agent, or Firm*—Cornelius J. O'Connor

[57] ABSTRACT

A high-resolution color television electron gun is disclosed for use in a high-brightness cathode ray tube having an unsegmented cathodoluminescent screen for producing a monochromatic image. The electron gun provides three horizontally oriented in-line beams lying in the deflection plane of the tube and converged into substantial coincidence on the screen. The diameters of the beams and hence resolution of the monochromatic image is inversely related to the magnitude of the beam currents. The gun includes associated cathode means and grid electrode means for forming each of the beams. A main focus lens for each of the beams includes at least a focusing electrode and an accelerating electrode for receiving a predetermined pattern of applied voltages for establishing beam-forming and accelerating electrostatic fields. The magnitude of the applied voltages are such that the beam currents are relatively low providing for small beam diameters and consequent high resolution. The brightness of the monochromatic image provided by the gun according to the invention is greater by approximately three times, without the loss of resolution, the brightness attained by a single-beam electron gun of equivalent beam current.

28 Claims, 8 Drawing Figures

| CONDITION | BEAM CURRENT IN MILLI-AMPS | LINE WIDTH IN MILS | | |
|---|---|---|---|---|
| | | SINGLE BEAM GUN | THREE BEAM GUN* | DIFFERENCE |
| A | 0.25 | 50 | 45 | +5 |
| B | 0.50 | 100 | 55 | +45 |
| C | 1.00 | 186 ** | 90 | +96 |
| D | 1.25 | 228** | 115 | +113 |

*— An electron gun according to the invention.

**- These figures are extrapolated.

MEANS FOR ENHANCING BRIGHTNESS OF A MONOCHROME CRT WITHOUT LOSS OF RESOLUTION

BACKGROUND OF THE INVENTION AND PRIOR ART STATEMENT

This invention relates in general to unsegmented monochromatic cathode ray tube image displays, and is particularly concerned with means for enhancing the brightness of such displays, without loss of resolution.

High brightness, resolution and contrast are requisites for the discernibility of monochromatic cathode ray tube information displays. These requisites are difficult to achieve because the enhancement of one of the factors may result in the deterioration of another. For example, attempting to increase the image brightness by increasing cathode ray tube beam current results in loss of resolution as beam diameter, and hence beam spot size (or line width), is almost directly proportional to beam current. An increase in beam current from one milliampere to two milliamperes in a standard bipotential gun, for example, will normally increase spot size by forty percent. And the larger the beam spot size, the lower the resolution. Another example: Image contrast is normally enhanced by installing a neutral density filter over the glass face panel of the cathode ray tube, or by introducing neutral density filter elements into the composition of the face panel. However, any increase in contrast by this means results in lower image brightness. The application of a filter of twenty percent density, for example, will result in a twenty percent brightness loss. A loss of this magnitude in conventional cathode ray tubes can wash out an image under bright ambient light conditions.

The electron gun according to one embodiment of the present invention represents a new and useful improvement of the electron gun having an extended field main focus lens described and claimed in U.S. Pat. No. 3,995,194 to Blacker et al, assigned to the present assignee, and incorporated herein by reference. The novel focus lens set forth by the '194 patent takes advantage of the low aberrations produced by the extended field lens described and claimed in U.S. Pat. No. 3,895,253 to Schwartz et al, also of common ownership herewith. The extended field provides reduced beam spot size over a wide range of beam currents, and thus offers markedly improved picture resolution in all screen sizes.

In U.S. Pat. No. 3,696,261, Miyaoka discloses a color cathode ray tube of increased brightness having a group of beams for each color element. The screen is segmented in that the red, green and blue phosphors are in discrete sets, or arrays, over the area of the screen. In one embodiment, six beams are generated, with paired beams having a common landing point on a corresponding red, green or blue stripe after passing through a color selection electrode. The pairs of beams pass through a common optical center of the main focus lens. In another aspect, nine beams are generated to provide trios of beams having common landing points on corresponding color stripes. The beams, whether in pairs or trios, are oriented in a vertical plane.

OBJECTS OF THE INVENTION

It is a general object of this invention to provide an improved monochrome cathode ray tube image display.

It is a less general object of this invention to provide a monochrome cathode ray tube image display having enhanced image discernibility in a high-brightness ambient environment.

It is a more specific object of this invention to provide cost-effective means for enhancing the brightness of cathode ray tubes having unsegmented monochromatic imaging screens.

It is a specific object of this invention to provide three-beam electron gun means providing for enhanced brightness of unsegmented screen, monochromatic cathode ray tube displays without loss of resolution.

BRIEF DESCRIPTION OF THE DRAWINGS

The features of the present invention which are believed to be novel are set forth with particularity in the appended claims. The invention, together with objects and advantages thereof, may be best understood, however, by reference to the following description taken in conjunction with the accompanying drawings, in the several figures of which like reference numerals identify like elements, and in which:

DESCRIPTION OF THE PREFERRED EMBODIMENT

Figure 1:
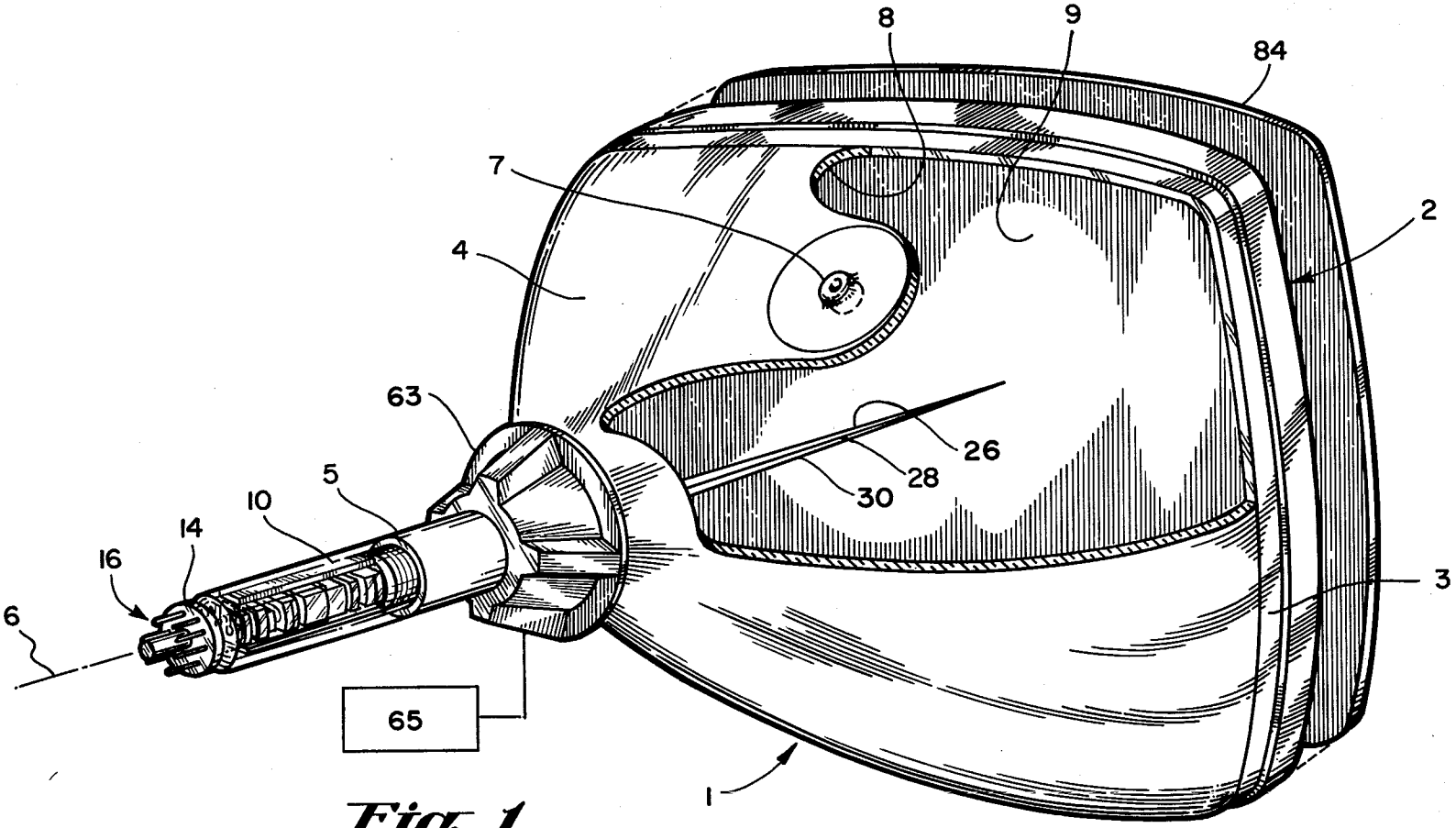
FIG. 1 is a view in perspective of a cathode ray tube according to the invention partly cut away to show internal details.

With reference to FIG. 1, there is depicted a high-brightness cathode ray imaging tube configured according to the principles of the invention. The evacuated glass envelope of tube 1 essentially comprises a face panel 2 having a rearwardly extending flange 3, a funnel 4, a neck 5, all aligned on the tube central axis 6. Funnel 4 has an anode button 7 therethrough for introducing a high voltage into the envelope; anode button 7 makes contact with a conductive coating 8 deposited on the inner surface of funnel 4. The inner surface of face panel 2 has deposited thereon an unsegmented cathodoluminescent screen 9 for producing a monochromatic image under electron bombardment. An "unsegmented" screen is defined as one comprising an homogeneous deposit of phosphor(s); that is, one having no discrete arrays of multicolor groups in the form of dots or stripes.

Figure 2:
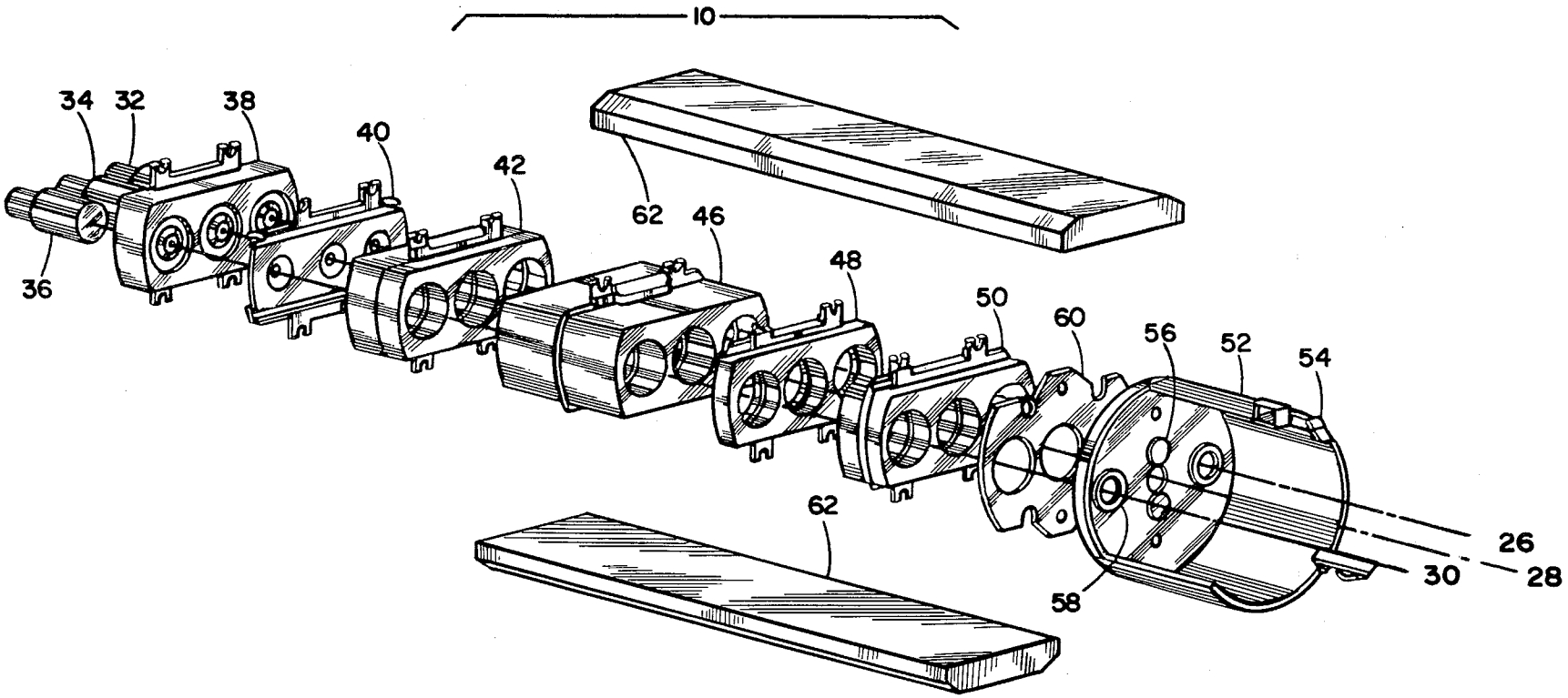
FIG. 2 is an exploded view in perspective of the components of a high-resolution color television electron gun according to an embodiment of the invention.
Figure 3:
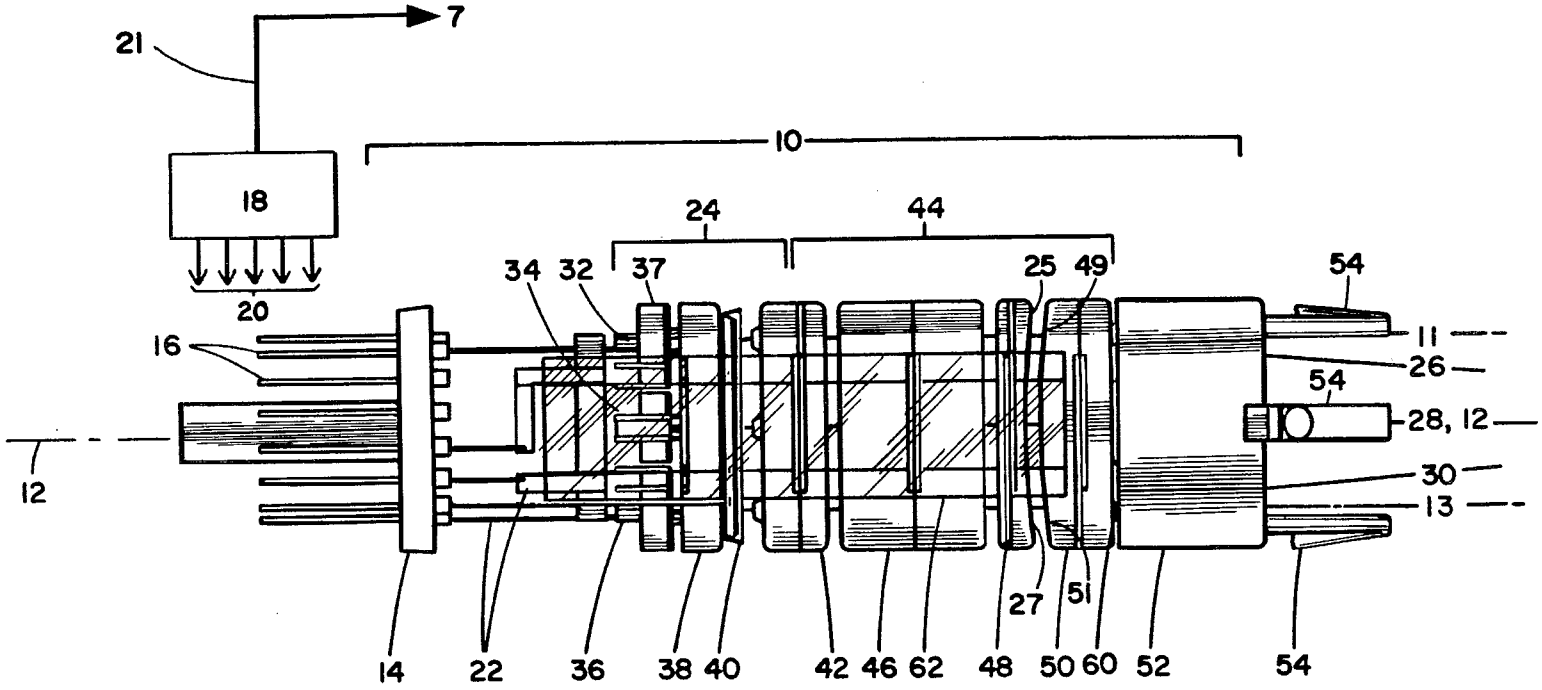
FIG. 3 is an assembled top view of the electron gun shown by FIG. 2.

Disposed within neck 5 of tube 1 is a high-resolution, in-line color television electron gun according to an embodiment of the invention, which is shown in detail in FIGS. 2 and 3. Electron gun 10 is depicted as being a "unitized" gun; that is, a gun in which common structures are used for different gun parts. Electron gun 10 according to this embodiment of the invention provides three horizontally oriented, coplanar, in-line beams, each of which is formed, shaped and directed to activate the cathodoluminescent screen 9 of cathode ray tube 1. The beams are converged into substantial coincidence on screen 9.

Electron gun 10 is illustrated as having a central axis 12 which is substantially congruent with the central axis 6 of tube 1. A cathode ray tube base 14 provides a plurality of lead-in pins 16 for introduction into the envelope of tube 1 the video signals, as well as certain voltages for beam forming, focusing, and accelerating. A power supply 18, depicted schematically, provides a predetermined pattern of applied voltages including a relatively low, relatively intermediate, and relatively high voltages for application to selected grids of tetrode section 24 and to the electrodes of main focus lens section 44 of gun 10 for establishing beam focusing and accelerating electrostatic fields. Relatively low and relatively intermediate voltages from power supply 18 are applied to the electron gun through a plurality of external leads 20 routed through the lead-in pins 16 of base 14. The relatively high applied voltage is routed to the anode button 7 of tube 1 through a high-voltage conductor 21. The operating signals, and the low and intermediate applies voltages, are conveyed to the several electrodes of gun 10 within the glass envelope by means of internal electrical leads; typical leads are shown by 22.

The tetrode section 24 of gun 10 includes associated cathode means and grid means for forming each of the beams. Three separate beam cross-overs (not shown), are generated, one for each of the three coplanar beams 26, 28 and 30 that lie mainly on three axes 11, 12 and 13 in the deflection plane of tube 1. The four elements of the tetrode section 24 may comprise, by way of example: (1) three discrete cathodes 32, 34 and 36, one for each beam, and supported by a common cathode support 37; (2) a unitized, three-apertured first grid (or "G1") 38 partially enclosing cathodes 32, 34 and 36; (3) a unitized, three-apertured disc-type second grid ("G2") 40; and (4) a unitized, three-apertured grid ("G3") 42. Each of the three apertures is in axial alignment with one of the three beams 26, 28 and 30.

The three beam cross-overs are imaged on the screen 9 of cathode ray tube 1 by main focus lens 44. In the illustrated embodiment, the main focus lens electrodes for the three beams 26, 28 and 30 are unitized and constituted as the "upper end" section, or section facing toward the tube screen. The main focus lens 44 comprises at least a first, second, and third electrode, and in this embodiment of the invention, lens 44 is shown as including common main focus electrode 42, and common main focus electrodes 46, 48 and 50. Each of these unitized electrodes is electrically isolated from the others. Main focus lens 44 according to this embodiment of the invention is a low-aberration, low-magnification, extended field lens comprising first, second, third and fourth electrode means 42, 46, 48 and 50 for receiving a predetermined pattern of applied voltages including a relatively intermediate applied voltage applied to the first and third electrode means 42 and 48, a relatively low applied voltage applied to second electrode means 46, a relatively high applied voltage applied to the fourth electrode means 50. Main focus lens 44 establishes an electrostatic field having an axial potential distribution which decreases from a relatively intermediate axial potential to a relatively low axial potential, and then increases to a relatively high axial potential.

The magnitudes of the applied voltages are commonly a relatively intermediate voltage of about 12 kV applied to first and third electrodes 42 and 48, a relatively low voltage of about 8 kV applied to second electrode 46, and a relatively high voltage of 28–32 kV applied to the fourth electrode 50.

In the gun according to this embodiment of the invention, the magnitude of the applied voltages are such that the beam currents are relatively low, providing for small beam diameters and consequent high resolution. The applied voltages for the electron gun 10 according to this embodiment of the invention may be, for example: 8.5–11 kV on the first and third electrodes 42 and 48, 4.3–5.5 kV on the second electrode 46, and 17–22 kV on the fourth electrode 50.

Further shaping, directing and focusing of the electron beams 26, 28 and 30 is accomplished between electrodes 48 and 50, the configuration of which constitutes two separate electron lens components to effect convergence of the outer two beams 26 and 30 inwardly from their respective axes 11 and 13 to a common area of landing with central beam 28, which does not vary from a direct axial path coincident with the central axis 12 of tube 10. The convergence of outer beams 26 and 30 towards center beam 28 is accomplished in the illustrated embodiment by a slight angling of the two plano-parallel electrode faces 25 and 27 of the two outer beam apertures for beam 26 and 30 of electrode 48, and a parallel, matching angling of the opposed faces 49 and 51 of electrode 50. The angles extend outwardly and forwardly relative to the gun's central axis 12, as shown by FIG. 3. This convergence electrode concept does not constitute per se an aspect of the present invention, but is described and claimed in U.S. Pat. No. 4,048,753 of common ownership herewith.

The last in the series of elements that comprise the illustrated embodiment is a support cup 52 that provides a mounting base for the three contact springs 54 which center the forward end of the gun in the neck of the cathode ray tube. Also, through contact with the electrically conductive coating 8 of tube 1, contact springs 54 conduct high voltage through support cup 52 to electrode 50. Located within the cavity formed by the support cup, and adjacent to the apertures from which the three electron beams 26, 28 and 30 emerge, are enhancer means 56 and shunt means 58. Support cup 52 is aligned and bonded to electrode 50 in precise registration by means of a carrier plate 60 which lies between the two elements.

In the unitized, in-line gun according to this embodiment of the invention, unitized grids and electrodes 38, 40, 42, 46, 48 and 50 have on each side thereof at least one pair of widely spaced, relatively narrow claws embedded at spaced points on wide beads 62. This structural concept does not constitute, per se, an aspect of this invention but is described and claimed in U.S. Pat. No. 4,032,811 issued to the assignee of this invention.

As noted, except for the three discrete cathodes 32, 34 and 36, the individual electrodes are "unitized"; that is, they each comprise one mechanical assembly having individual axially aligned apertures for the three coplanar beams 26, 28 and 30. Gun electrodes 42, 46, 48 and 50 are further characterized by having three effectively continuous, electrically shielding beam-passing tubes extending completely through the electrodes, each tube being formed by a contiguous axial succession of deep-drawn annular lips. This concept does not constitute per se an aspect of this invention but is described and claimed in U.S. Pat. No. 4,119,884, of common ownership herewith.

As has been noted, beam convergence in the center area of the screen can be provided by the slight angling of opposed electrode faces 25 and 27 of the two outer beam apertures of the electrodes 48 and 50 of gun 10, thus providing electrostatic, "static", convergence. As the beams are scanned across screen 9 of tube 1, however, it is necessary to provide "dynamic" convergence to maintain coincidence of the landing areas of the beams 28, 30 and 32 on the screen 9. The need for this constant converging of the beams is due to several factors, a significant one of which is the change in "throw distance" as the beams scan the screen from center to the sides and center to the top and bottom. When an electron beam is scanning, the point of focus and convergence of the beam normally defines an arc in the horizontal and vertical planes. However, the area being scanned—the picture imaging screen—lies on an arc of much greater radius, and hence is relatively planiform in comparison. The result can be misconvergence in off-axis areas, especially in the corners of the rectangular viewing screen.

Beam convergence may be achieved dynamically by slightly varying the relative angles of the beams while scanning. In dynamic convergence by electronic circuit means in an image display system, for example, signals to induce dynamic convergence may be derived from the horizontal and vertical circuits of the television receiver system to provide a dynamic convergence-correction signal having the characteristics of a parabola. The voltage of the convergence-correcting signal is zero at the center of the picture imaging field, and changes towards the sides of the screen to effect convergence. Dynamic convergence signals may be applied to convergence coils located adjacent to the picture tube neck. Such a dynamic convergence circuit is disclosed by Nelson in U.S. Pat. No. 2,834,911. Parabolic convergence current waves are obtained by integration of pulse and saw tooth voltage waves in resistive and inductive reactive circuits, according to the teachings of Nelson.

Means for converging beams 26, 28 and 30 into substantial coincidence on screen 9 are indicted in FIG. 1 as comprising deflection yoke 63, shown as encircling neck 5 and embracing a section of the funnel 4. The electronic circuit convergence means 65 are indicated schematically in FIG. 1 by the block electrically connected to yoke 63.

Yoke 63 may be of the type which provides for self-convergence of multiple beams without the need for special electronic circuitry. The "self-converging" yoke has, in addition to main deflection field components that provide for scanning of the beams, an additional quadrupolar component which maintains the beams in convergence as they are deflected across the screen. An example of a yoke providing for the self-convergence of multiple beams is disclosed by Chiodi in U.S. Pat. No. 3,643,192, assigned to the present assignee, and incorporated herein by reference.

The effect of the means according to the invention is such that the brightness of the monochromatic image is approximately three times greater, without loss of resolution, than the brightness attained by a single-beam electron gun of equivalent beam current.

It will be recognized that absolute registration of multiple beam landing areas at all points on the screen is very difficult to attain. The effect of misregistration of the beams in which the landing areas are in the form of round "spots" of light on the screen is shown by FIG. 4.

Figures 4, 5:
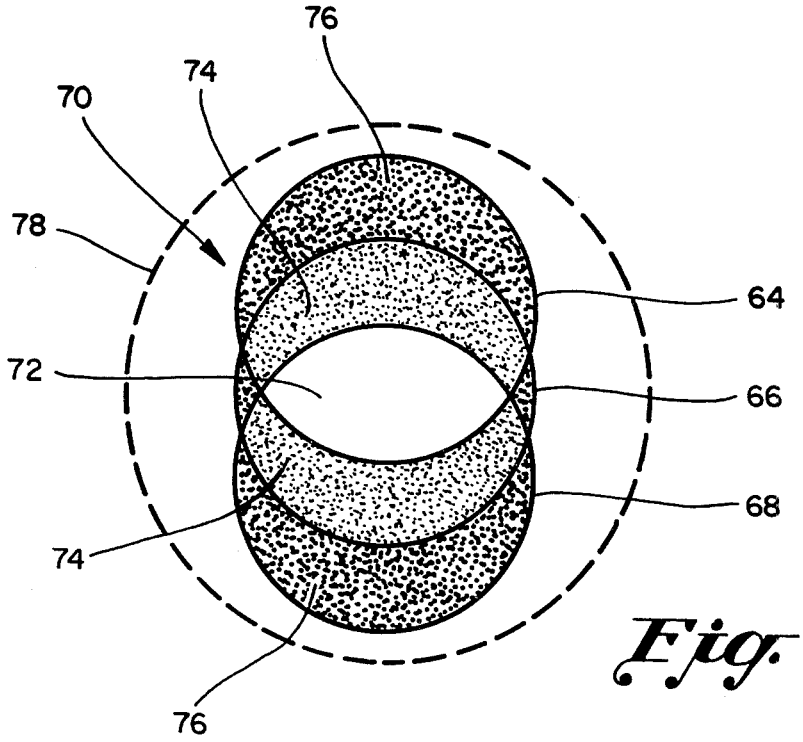
FIG. 4 indicates diagramatically the effects of misregistration on the landing areas of multiple electron beams.
FIG. 5 indicates in tabular form the benefits attained by the means according to the invention in terms of image brightness and resolution.

Three misregistered beam spots 64, 66 and 68 are depicted as a group 70 in FIG. 4 in what may be considered a typical condition of misregistration for a non-center-screen, off-axis position of the beam landing area. In the center area 72, where all three beam spots 64, 66 and 68 overlap, the beam current will be densest, and the composite spot brightest. The next brightest areas will be areas 74, where to of the spots overlap, and the least bright areas will be areas 76, where there is no overlap. The total brightness of a group 70 of typically misconverged beams will of course not be brighter by a factor of exactly three times, but the brightness of a well-registered group will be substantially greater by approximately three times the brightness attained by a single-beam electron gun having a beam current equal to the total current of the three beams. The brightness of a single beam could be equivalent to the brightness of an area 76, for example, wherein the current of a single beam is the same as the total beam current of the afore-described three beams. An attempt to increase the brightness of a gun producing a single beam by increasing its beam current will cause the beam to "bloom" and the diameter of the beam will also increase in diameter to that of the much larger spot 78 indicated by the encircling dash lines. The result is a great falling off in resolution with only a minimal increase in brightness.

The brightness of the image display is enhanced by the use of a high-efficiency phosphor on the imaging screen 9. An example of a monochromatic phosphor able to implement image brightness is the "P43," which provides a yellowish-green fluorescence. The formula is $Gd_2O_2S$:Tb. The brightness of a cathodoluminescent image activated by the means according to the principles of the invention is limited mainly by phosphor saturation effects.

With reference to FIG. 1, a neutral density filter 84 is indicated as being applied to the face panel 2 of cathode ray tube 1. Neutral density filter means associated with the screen provide for enhancing the contrast of the image where a high-contrast image display is required. A neutral density filter in the preferred range of 10–20 percent will result in an equivalent brightness loss; however, the enhancement in image contrast is such that the image can be clearly discerned even in bright sunlight.

In lieu of providing a discrete neutral density filter 84 as indicated in FIG. 1, the glass of the face panel can be compounded to exhibit the required grade of neutral density by means well known in the glass-making art.

The benefits of high resolution conferred by the preferred embodiment of the invention are indicated by the table, FIG. 5. Four conditions A–D are shown wherein the magnitude of discrete beam currents is increased in four increments from 0.25 to 1.250 milliamperes. The landing point of a beam from a single gun, or the converged beams of a three-beam gun according to the invention, is designated as "line width," although it could as well be "spot diameter."

Under condition A, wherein the beam currents are designated as 0.25 milliamperes, the line width of a single beam gun is 50 mils, as against 45 mils for the three-beam gun.

As beam current is increased, the line width of the beam for the single gun increases greatly, whereas the line width of the three converged beams of the guns according to the preferred embodiments of the invention increase to a markedly less extent. For example, as indicated in FIG. 5 for condition D, line width is 113 mils wider for the single beam gun.

While particular embodiments of the invention have been shown and described, it will be readily apparent to those skilled in the art that changes and modifications may be made without departing from the invention in its broader aspects. For example, the principles of the invention are applicable to the bipotential electron gun 90, indicated in FIG. 6, and the unipotential electron gun 92, indicated in FIG. 7. It will be recognized that each figure is a schematic representation of the electrode components for forming one beam of a three-beam electron gun having the in-line configuration represented highly schematically by FIG. 8. The components of gun 94 indicated by FIG. 8 for providing each of the three beams 96, 98 and 100 are depicted as being separate "barrels," that is, discrete electrodes for each beam. This is in contradistinction to the configuration of gun 10, depicted by FIGS. 1, 2 and 3, wherein the electrodes are "unitized." It is noted that the three electron guns according to the principles of the invention—the bipotential, the unipotential, and the extended field gun—may be unitized or may comprise discrete "ununitized" electrodes for each of the three beams.

Figure 6:
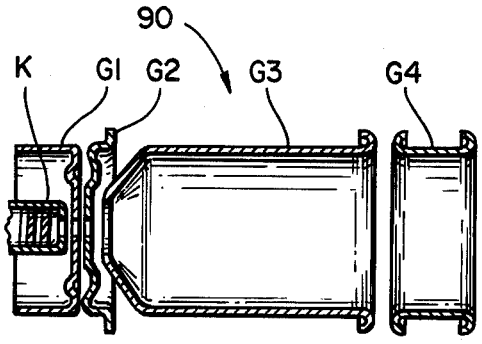
FIGS. 6 and 7 are longitudinal cross-sections of a bipotential electron gun and a unipotential electron gun, respectively.
Figure 7:
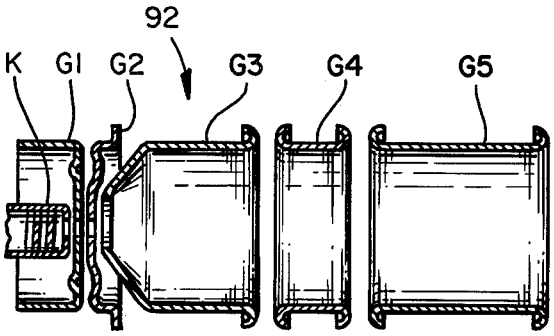
Figure 8:
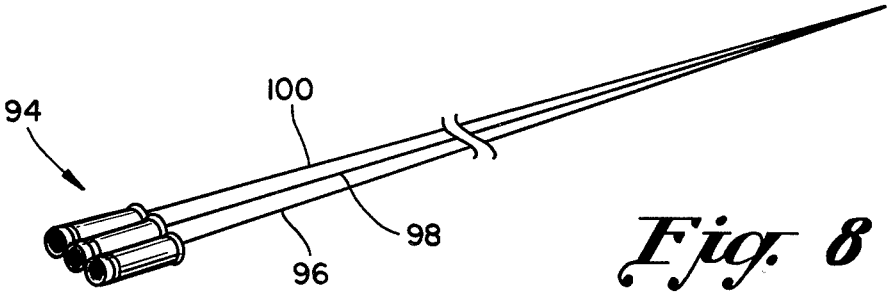
FIG. 8 is a diagrammatic representation in perspective of the configuration and projected beam pattern of the in-line type of electron gun.

The bipotential electron gun 90 and the unipotential electron gun 92 shown by the respective FIGS. 6 and 7 are for use in a high-brightness cathode ray tube having an unsegmented cathodoluminescent screen for producing a monochromatic image. A tube of this type is depicted in FIG. 1 (ref. No. 1) and is described supra in relation to an electron gun (ref. No. 10) having an extended field lens. The three types of gun—bipotential, unipotential, and extended field—are for use in the cathode ray tube described, as well as in a system according to the invention as described infra. The high resolution color television guns provide three electron beams converged into substantial coincidence on the aforedescribed unsegmented cathodoluminescent screen for producing a monochromatic image. The diameters of the beams and hence the resolution of the monochromatic image is inversely related to the magnitude of the beam currents. Bipotential gun 90 and unipotential gun 92 have beam forming lower end means including associated cathode means (K) and grid electrode means (G1 and G2) for forming each of the three beams. Bipotential gun 90 has a two-element main focus lens means for each of the three beams consisting of a focusing electrode (G3) and an accelerating electrode (G4) for receiving a predetermined pattern of applied voltages for establishing beam-focusing and accelerating electrostatic fields. The magnitude of the applied voltages are such that the beam currents are relatively low providing for small beam diameters and consequent high resolution. The magnitude of the applied voltages may be in the range of 5.1 to 6.6 kilovolts on the focusing electrode (G3) and 17 to 22 kilovolts on the accelerating electrode (G4). In conventional bipotential guns, the respective potentials are about 8 kilovolts on the focusing electrode (G3) and 30 kilovolts on the accelerating electrode (G4).

The unipotential gun 92 has a three-element main focus lens means for each of the three beams consisting of a first lens electrode (G3), a second lens electrode (G4), and a third lens electrode (G5). The unipotential main focus lens means includes at least a focusing electrode and an accelerating electrode for receiving a predetermined pattern of applied voltages for establishing beam focusing and accelerating electrostatic fields. The magnitude of the applied voltages are such that the beam currents are relatively low, providing for small beam diameters and consequent high resolution. The magnitude of the applied voltages according to the principles of the invention may be in the range of 17 to 22 kilovolts on the first lens electrode (G3), 0 to 6 kilovolts on the second lens electrode (G4), and 17 to 22 kilovolts on the third lens electrode (G5). In conventional unipotential guns, the respective voltages are commonly 30 kilovolts on the G3 and G5 electrodes, and 0 to 5 kilovolts on the G4 electrode.

The effect in bipotential gun 90 and unipotential gun 92 according to the invention is such that the brightness of the monochromatic image is approximately three times greater without loss of resolution than the brightness attained by a single-beam electron gun of equivalent beam current.

It will be noted that the means according to the principles of the invention provide a highly cost-effective approach to the problem of enhancing the brightness of unsegmented, monochromatic cathode ray tube image displays without loss of resolution.

A high-brightness, high-resolution image display system according to the principles of the invention for providing enhanced image discernability under bright ambient conditions may comprise a cathode ray tube 1 (see FIG. 1) having an unsegmented cathodoluminescent screen for providing a monochromatic image; a power supply for providing operating voltages (see FIG. 2); a high-resolution three-beam color television in-line electron gun such as the bipotential, unipotential or extended field (see FIGS. 2, 3, 5 and 6). The system also includes means for converging the three beams into substantial coincidence on the unsegmented screen, and neutral density filter means (FIG. 1) for enhancing the contrast of the monochromatic image.

The aim of the appended claims is to cover all changes and modifications as fall within the true spirit and scope of the invention such as might occur to those skilled in the art.

We claim:

1. For use in a high-brightness cathode ray tube having an unsegmented cathodoluminescent screen for producing a monochromatic image, a high-resolution, in-line color television electron gun providing three horizontally oriented in-line electron beams converged into substantial coincidence on said screen, the diameters of said beams and hence resolution of said monochromatic image being inversely related to the magnitude of the beam currents, said gun having beam-forming lower end means including associated cathode means and grid electrode means for forming each of said beams, and main focus lens means for each of said beams including at least a focusing electrode and an accelerating electrode for receiving a predetermined pattern of applied voltages for establishing beam-focusing and accelerating electrostatic fields, the magnitude of said applied voltages being such that said beam currents are relatively low providing for small beam diameters and consequent high resolution, such that the brightness of said monochromatic image is approximately three times greater, without loss of resolution, than the brightness attained by a single-beam electron gun of equivalent beam current.

2. The electron gun defined by claim 1 wherein said electrodes are discrete electrodes for each beam.

3. The electron gun defined by claim 1 wherein said electrodes are unitized.

4. For use in a high-brightness cathode ray tube having an unsegmented cathodoluminescent screen for producing a monochromatic image, a high-resolution, bipotential, in-line color television electron gun providing three horizontally oriented electron beams converged into substantial coincidence on said screen, the diameters of said beams and hence resolution of said monochromatic image being inversely related to the magnitude of the beam currents, said gun having beam-forming lower end means including associated cathode means and grid electrode means for forming each of said beams, and two-element main focus lens means for each of said beams consisting of a focusing electrode and an accelerating electrode for receiving a predetermined pattern of applied voltages being such that said beam currents are relatively low providing for small beam diameters and consequent high resolution, such that the brightness of said monochromatic image is approximately three times greater, without loss of resolution, than the brightness attained by a single-beam electron gun of equivalent beam current.

5. The electron gun defined by claim 4 wherein said electrodes are discrete electrodes for each beam.

6. The electron gun defined by claim 4 wherein said electrodes are unitized.

7. The electron gun defined by claim 4 wherein the magnitude of said applied voltages is in the range of 5.1 to 6.6 kilovolts on said focusing electrode, and 17 to 22 kilovolts on said accelerating electrode.

8. For use in a high-brightness cathode ray tube having an unsegmented cathodoluminescent screen for producing a monochromatic image, a high-resolution, unipotential color television electron gun providing three horizontally oriented in-line electron beams converged into substantial coincidence on said screen, the diameters of said beams and hence resolution of said monochromatic image being inversely related to the magnitude of the beam currents, said gun having beam-forming lower end means including associated cathode means and grid electrode means for forming each of said beams, and a three-element main focus lens means for each of said beams consisting of first, second and third lens electrodes including at least a focusing electrode and an accelerating electrode for receiving a predetermined pattern of applied voltages for establishing beam-focusing and accelerating electrostatic fields, the magnitude of said applied voltages being such that said beam currents are relatively low providing for small beam diameters and consequent high resolution, such that the brightness of said monochromatic image is greater by approximately three times greater, without loss of resolution, than the brightness attained by a single-beam electron gun of equivalent beam current.

9. The electron gun defined by claim 8 wherein said electrodes are discrete electrodes for each beam.

10. The electron gun defined by claim 8 wherein said electrodes are unitized.

11. The electron gun defined by claim 8 wherein the magnitude of said applied voltages is in the range of 17 to 22 kilovolts on said first lens electrode, 0 to 6.6 kilovolts on said second lens electrode, and 17 to 22 kilovolts on said third electrode.

12. For use in a high-brightness cathode ray tube having an unsegmented cathodoluminescent screen for producing a monochromatic image, in-line color television electron gun providing three horizontally oriented, in-line beams lying in the deflection plane of said tube and converged into substantial coincidence on said screen, the diameters of said beams and hence resolution of said monochromatic image being inversely related to the magnitude of the beam currents, said gun having:

associated cathode means and grid means for producing said beams; and a low-aberration, low-magnification, extended field main focus lens comprising at least first, second, third and fourth electrodes, said first and third electrodes receiving a relatively intermediate applied voltage, said second electrode receiving a relatively low applied voltage, and said fourth electrode receiving a relatively high applied voltage, said main focus lens establishing an electrostatic field having an axial potential distribution which decreases from a relatively intermediate axial potential to a relatively low axial potential, then increases to a relatively high axial potential, the magnitude of said applied voltages being such that said beam currents are relatively low providing for small beam diameters and consequent high resolution, such that the brightness of said monochromatic image is approximately three times greater, without loss of resolution, than the brightness attained by a single-beam electron gun of equivalent beam current.

13. The electron gun defined by claim 12 wherein said electrodes are unitized.

14. The electron gun defined by claim 12 wherein the magnitude of said applied voltages is in the range of 5 to 7 kilovolts on said first and third electrode means, 4.3 to 5.5 kilovolts on said second electrode means, and 17 to 22 kilovolts on said fourth electrode means.

15. A high-brightness, high-resolution, high-contrast cathode ray imaging tube having an unsegmented cathodoluminescent screen for producing a monochromatic image, said tube including a high-resolution, in-line color television electron gun providing three electron beams for converging into substantial coincidence on said screen, the diameters of said beams and hence resolution of said monochromatic image being inversely related to the magnitude of the beam currents, said gun having beam-forming lower end means including associated cathode means and grid means for forming each of said beams, and main focus lens means for each of said beams including at least a focusing electrode and an accelerating electrode for receiving a predetermined pattern of applied voltages for establishing beam-focusing and accelerating electrostatic fields, the magnitude of said applied voltages being such that said beam currents are relatively low providing for small beam diameters and consequent high resolution, said tube including self-converging yoke means for converging said beams, and associated neutral density filter means for providing high contrast, such that the brightness of said monochromatic image is approximately three times greater, without loss of resolution, than the brightness attained by a single-beam electron gun of equivalent beam current.

16. The cathode ray tube according to claim 15 wherein said electron gun is a bipotential gun.

17. The cathode ray tube according to claim 15 wherein said electron gun is a unipotential gun.

18. The cathode ray tube according to claim 15 wherein said electron gun is of the type having an extended field main focus lens.

19. The cathode ray tube according to claim 15 wherein said electrodes of said gun are discrete electrodes for each beam.

20. The cathode ray tube according to claim 15 wherein said electrodes of said gun are unitized.

21. A high-contrast, high-resolution cathode ray imaging tube for providing enhanced image discernibility under bright ambient conditions, said tube having an unsegmented cathodoluminescent screen for producing a monochromatic image, said tube comprising in combination:

a high-resolution color television electron gun providing multiple, horizontally oriented, in-line electron beams lying in the deflection plane of said tube for converging into coincidence on said screen, the diameters of said beams and hence resolution of said monochromatic image being inversely related to the magnitude of the beam currents, said gun including:

associated cathode means and grid means for producing said beams;

a low-aberrations, low-magnification, extended field main focus lens comprising first, second, third and fourth electrode means receiving a predetermined pattern of applied voltages including a relatively intermediate applied voltage applied to said first and third electrode means, a relatively low applied voltage applied to said second electrode means, and a relatively high applied voltage applied to said fourth electrode means, said main focus lens means establishing an electrostatic field having an axial potential distribution which decreases from a relatively intermediate axial potential to a relatively low axial potential, and then increases to a relatively high axial potential, the magnitude of said applied voltage being such that said beam currents are relatively low providing for small beam diameters and consequent high resolution;

means for converging said beams into substantial coincidence on said screen;

neutral density filter means associated with said screen for enhancing the contrast of said monochromatic image;

such that the brightness of said monochromatic image is approximately three times greater, without loss of resolution, than the brightness attained by a single-beam electron gun of equivalent beam current.

22. The cathode ray imaging tube according to claim 21 wherein said means for converging said beams comprises a self-converging yoke.

23. The cathode ray imaging tube according to claim 21 wherein said means for converging said beams comprises electronic circuit dynamic convergence means.

24. The cathode ray imaging tube according to claim 21 wherein said neutral density filter provides a filtration between ten and twenty percent.

25. A high-brightness, high-resolution monochromatic display system for providing enhanced image discernibility under bright ambient conditions comprising in combination:

a cathode ray tube having an unsegmented cathodoluminescent screen for providing the monochromatic image:

a power supply for providing operating voltages to said system;

a high-resolution color television electron gun for use in said tube, said gun providing multiple, horizontally oriented in-line electron beams lying in the deflection plane of said tube for converging into coincidence on said screen, the diameters of said beams and hence resolution of said image being inversely related to the magnitude of the beam currents, said gun having beam-forming lower end means including associated cathode means and grid electrode means for forming each of said beams, and main focus lens means for each of said beams including at least a focusing electrode and an accelerating electrode for receiving a predetermined pattern of applied voltages for establishing beam-focusing and accelerating electrostatic fields, the magnitude of said applied voltages being such that said beam currents are relatively low providing for small beam diameters and consequent high resolution;

means for converging said beams into substantial coincidence on said screen;

neutral density filter means associated with said screen for enhancing the contrast of said monochromatic image;

such that the brightness of said monochromatic image is approximately three times greater, without loss of resolution, than the brightness attained by a single-beam electron gun of equivalent beam current.

26. The image display system according to claim 25 wherein the means for converging said beams comprises a self-converging yoke associated with said tube.

27. The image display system according to claim 25 wherein the means for converging said beams comprises electronic circuit dynamic convergence means.

28. A high-contrast, high-resolution monochromatic image display system for providing enhanced image discernibility under bright ambient conditions, the combination comprising:

a cathode ray tube having an unsegmented cathodoluminescent screen for providing said monochromatic image;

a power supply for providing operating voltages to said system;

a high-resolution color television electron gun for use in said tube, said gun providing three horizontally oriented in-line electron beams lying in the deflection plane of said tube for converging into coincidence on said screen, the diameters of said beams and hence resolution of said monochromatic image being inversely related to the magnitude of the beam currents, said gun including:

associated cathode means and grid means for producing said beams;

a low-aberrations, low-magnification, extended field main focus lens comprising first, second, third and fourth electrode means receiving a predetermined pattern of applied voltages from said power supply including an applied voltage in the range of 5 to 7 kilovolts applied to said first and third electrode means, an applied voltage in the range of 4.3 to 5.5 kilovolts applied to said second electrode means, and an applied voltage in the range of 17 to 22 kilovolts applied to said fourth electrode means, said main focus lens means establishing an electrostatic field having an axial potential distribution which decreases from a relatively intermediate axial potential to a relatively low axial potential, and then increases to a relatively high axial potential, the magnitude of said applied voltages being such that said beam currents are relatively low providing for small beam diameters and consequent high resolution;

self-converging yoke means for converging said beams into substantial coincidence on said screen;

neutral density filter means associated with said screen for providing a filtration between ten and twenty percent;

such that the brightness of said monochromatic image is approximately three times greater, without loss of resolution, than the brightness attained by a single-beam electron gun of equivalent beam current.

* * * * *